United States Patent [19]

Tsuchida et al.

[11] Patent Number: 4,821,790

[45] Date of Patent: Apr. 18, 1989

[54] APPARATUS FOR POURING MOLTEN METAL

[75] Inventors: Yutaka Tsuchida, Yokosuka; Shuzo Takahashi, Yokohama; Shiro Osada, Yokohama; Hisashi Sato, Yokohama; Akichika Ozeki, Tokyo; Nobuhisa Hasebe, Yokohama, all of Japan

[73] Assignees: Ishikawajima-Harima Jukogyo Kabushiki Kaisha; Nippon Kokan Kabushiki Kaisha, both of Japan

[21] Appl. No.: 146,717

[22] Filed: Jan. 21, 1988

[51] Int. Cl.[4] ..... B22D 11/10

[52] U.S. Cl. ..... 164/430; 164/438

[58] Field of Search ..... 164/437, 438, 439, 440, 164/430, 431, 432, 434

[56] References Cited

U.S. PATENT DOCUMENTS

| | | | |
|---|---|---|---|
| 4,544,018 | 10/1985 | Figge et al. | 164/438 |
| 4,576,218 | 3/1986 | Artz et al. | 164/439 |
| 4,627,481 | 12/1986 | Keisers et al. | 164/440 |

*Primary Examiner*—Kuang Y. Lin

[57] ABSTRACT

A tundish nozzle is independent from a tundish so that thermal deformations of the tundish are not transmitted to the tundish nozzle.

6 Claims, 5 Drawing Sheets

APPARATUS FOR POURING MOLTEN METAL

BACKGROUND OF THE INVENTION

The present invention relates to an apparatus for pouring molten metal in a moving-mold type continuous casting machine.

FIG. 1 shows a conventional moving-mold type continuous casting machine comprising a plurality of block molds 1 interconnected in the form of a pair of endless mold assemblies 2 and 2'. Such mold assemblies 2 and 2' are disposed one upon another to define a continuous mold cavity between them. While the mold assemblies 2 and 2' are driven by drive wheels 3 and 3' in a direction indicated by arrows 4 and 4', molten metal is poured into the mold cavity at one side of the cavity through a tundish nozzle 6 extending from a tundish 5 and a castrand 7 is withdrawn from the other side of the mold cavity as indicated by arrow.

In order to prevent leakage of molten metal in the continuous casting machine of the type described above, a gap between the tundish nozzle 6 in the mold cavity and the block molds 1 defining the mold cavity must be kept at a predetermined small value with a high degree of dimensional accuracy.

To this end, conventionally used is a tundish-nozzle aligning system as shown in FIGS. 2–5 in which vertical position as well as nose-up and nose-down of the nozzle can be adjusted by operating handlewheels 25 operatively connected to jacks 24 mounted on a tundish-supporting stand 28. Horizontal position of the nozzle 6 can be adjusted by moving a jack stand 29 located below the tundish-supporting stand 28 by operating push bolts 26 and draw bolts 27 as shown in FIG. 4. As best shown in FIG. 5, rotational alignment (inclination in a plane perpendicular to a nozzle axis) of the nozzle can be adjusted by adjusting nuts 33 of specially designed bolts 32 pivotally joined with pivot pins 31 to a car frame 30.

However, use of the tundish-nozzle aligning system is not always effective for keeping the gap between the nozzle and the block molds at a predetermined small value. Because, high-temperature molten metal poured into the tundish 5 may cause deformations of the tundish 5, resulting in displacement in any directions of the tundish nozzle 6 extending therefrom and failure of maintaining the above-described predetermined gap. As a result, the tundish nozzle 6 strongly contacts the molds 1 and the nozzle 6 and the molds 1 are non-uniformly worn and damaged.

The present invention was made to overcome the above and other problems encountered in the conventional casting machines of the type described above and therefore has its object to eliminate adverse effects due to thermal deformations of a tundish on its nozzle so that a predetermined gap between the tundish nozzle and the block molds can be maintained at a satisfactory degree, thereby preventing damages to the tundish nozzle and the mold assemblies.

The above and other objects, effects and features of the present invention will become more apparent from the following description of some preferred embodiments thereof taken in conjunction with the accompanying drawings.

DETAILED DESCRIPTION OF THE PREFERRED EMBODIMENTS

Figure 1:
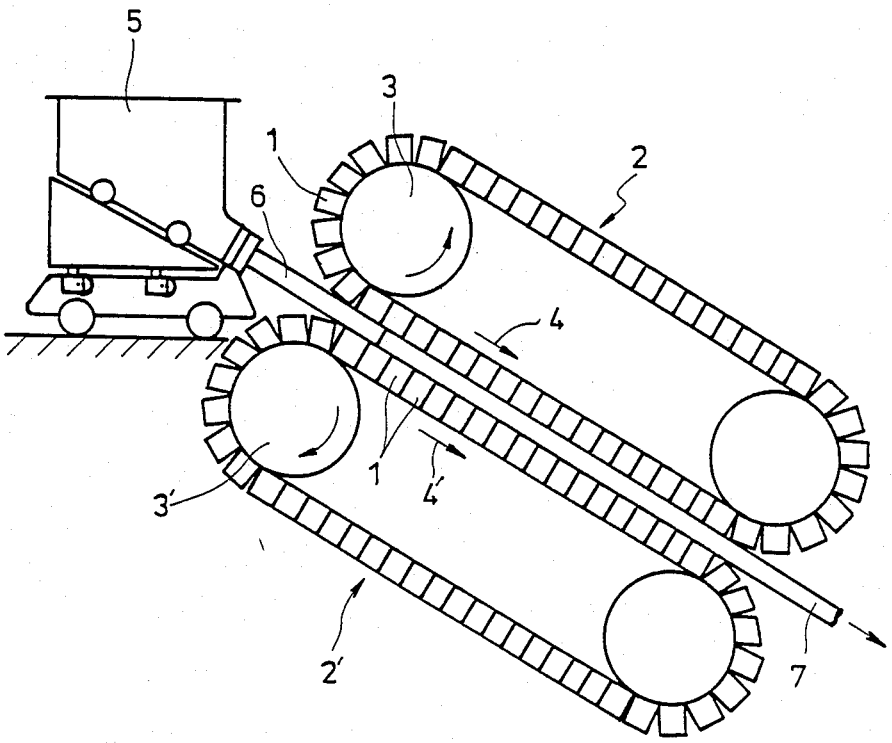
Fig.1 PRIOR ART
FIG. 1 is a side view of a conventional block-mold type continuous casting machine.
Figure 2:
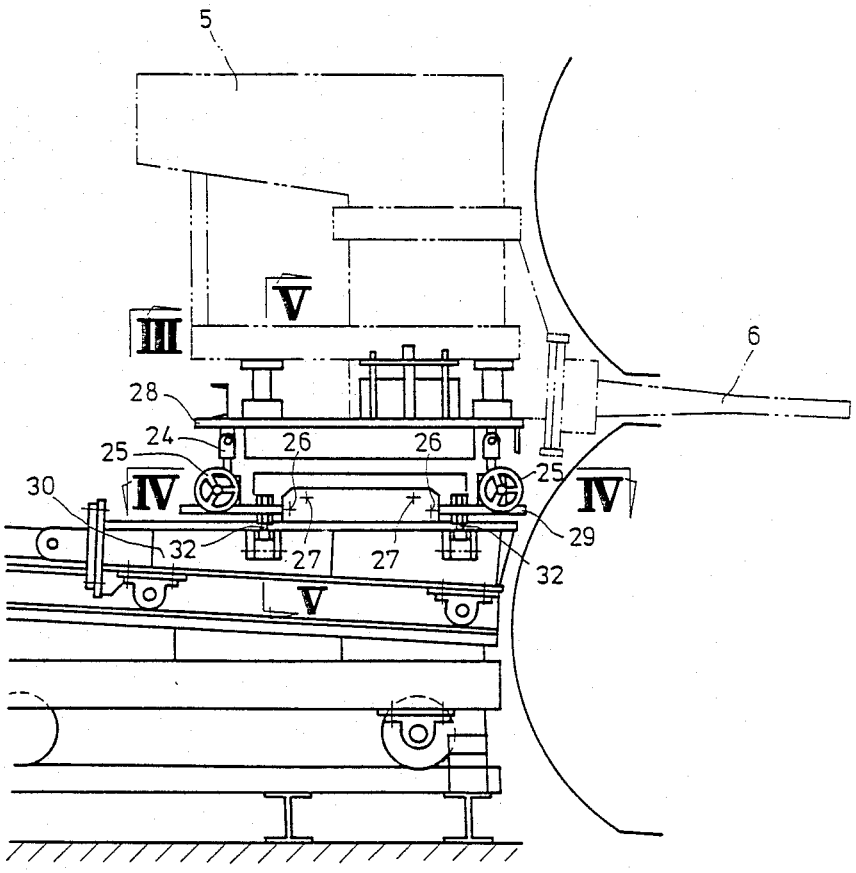
Fig. 2 PRIOR ART
FIG. 2 is a side view used to explain a conventional system for attaining alignment of a tundish nozzle.
Figure 3:
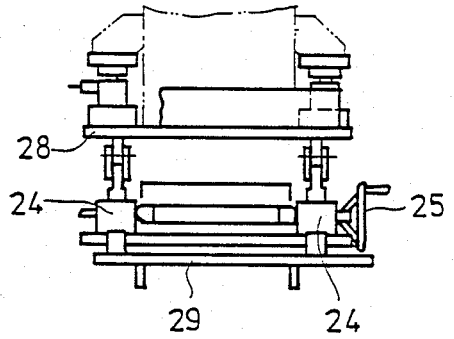
Fig. 3 PRIOR ART
FIG. 3 is a view looking in a direction indicated by the arrow III in FIG. 2.
Figure 4:
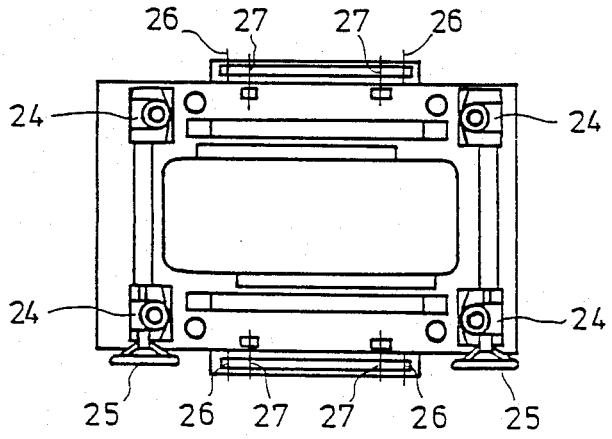
Fig. 4 PRIOR ART
FIG. 4 is a sectional view taken along the line IV—IV in FIG. 2.
Figure 5:
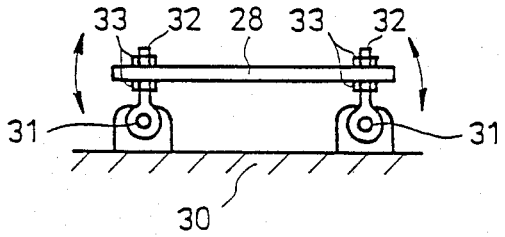
Fig. 5 PRIOR ART
FIG. 5 is a sectional view taken along the line V—V in FIG. 2.
Figure 6:
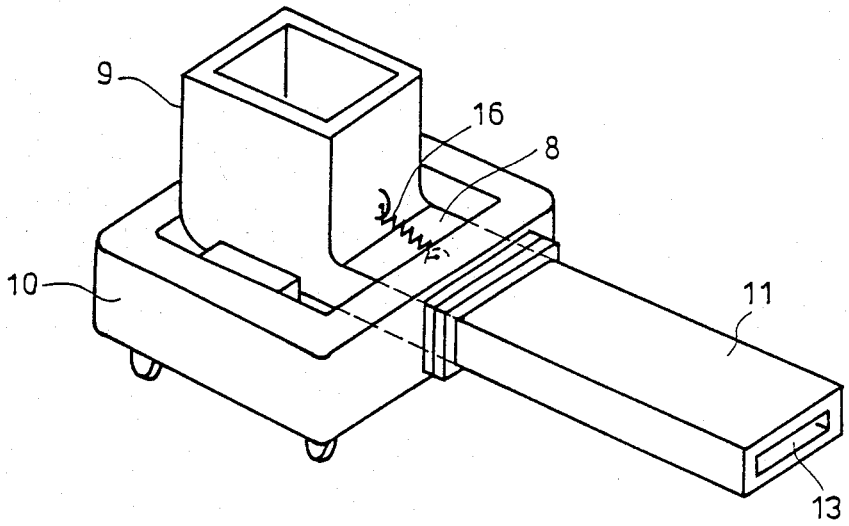
FIG. 6 is a perspective view of a first embodiment of the present invention.
Figure 7:
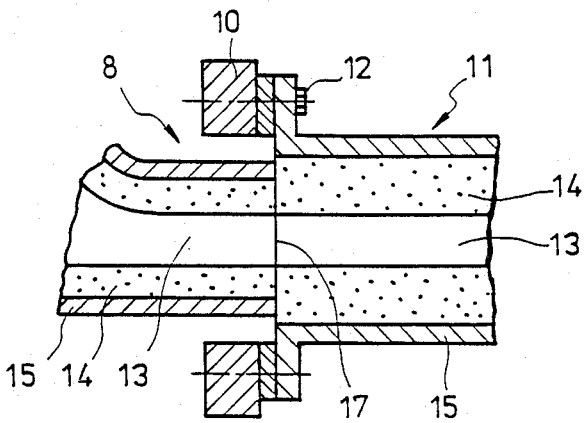
FIG. 7 is a detailed sectional view illustrating the joint between a molten-metal pouring outlet portion and a tundish nozzle.

FIGS. 6 and 7 show a first embodiment of the present invention. A tundish 9 with a short molten-metal pouring outlet portion 8 is mounted on a tundish car frame 10 to which a tundish nozzle 11 in alignment with the outlet portion 8 is secured by bolt means 12 or the like. The outlet portion 8 and the tundish nozzle 11 are composed of a refractory member 14 which has a coaxially extending pouring bore 13 and which is cladded with a steel shell 15. A downstream end of the outlet portion 8 is securely pushed and abutted, through spring means 16 or the like interposed between the tundish car frame 10 and the tundish 9, against the refractory member 14 of the tundish nozzle 11 for tight seal between the outlet portion 8 of the tundish 9 and the tundish nozzle 11. The car frame 10 is located by alignment means (not shown) such that the tundish nozzle 11 is located in association with the continuous casting machine.

The car frame 10 which supports the tundish 9 is not directly thermally affected by molten metal at high temperatures so that thermal deformations of the car frame 10 is substantially negligible.

It follows therefore that the tundish nozzle 11, which is mounted on the tundish car frame 10 substantially free from thermal deformations, can be maintained at a predetermined position with respect to the continuous casting machine.

Even when molten metal flow into the tundish 9 causes thermal deformations of the tundish 9 and consequently displacement of its pouring outlet portion 8, the gap between the tundish nozzle 11 and the block molds 1 can be maintained since such displacement of the outlet portion 8, which is independent from the nozzle 11, leads to slip movement of the outlet portion 8 itself along the abutment 17 rather than displacement of the tundish nozzle 11 secured to the tundish car frame 10. Leakage of molten metal at the abutment 17 is prevented since the outlet portion 8 is pressed against the refractory member 14 of the tundish nozzle 11 by spring means 16 or the like interposed between the tundish car frame 10 and the tundish 9.

With the above-mentioned construction, no molten metal will leak at the abutment 17 as described just above in slide movement of the outlet portion 8 along the abutment 17. However, when the outlet portion 8 is caused to contact the tundish nozzle 11 such that the axis of the outlet portion 8 makes an angle with the axis of the tundish nozzle 11, a gap results at the abutment 17 through which gap molten metal may leak. Therefore, means must be provided to prevent leakage of molten metal in this case.

Figure 8:
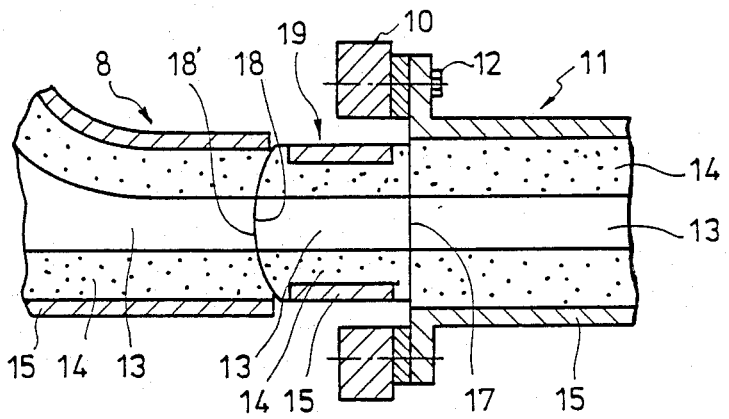
FIG. 8 is a sectional view of a second embodiment of the present invention.

A second embodiment of the present invention shown in FIG. 8 is equipped with such means for preventing the leakage of molten metal in the above-mentioned case. More particularly, interposed between the outlet portion 8 and the tundish nozzle 11 is an intermediate member 19 comprising a refractory member 14 having a coaxial pouring bore 13 and a steel shell 15 surrounding the member 14. The intermediate member 19 has a convex semispherical surface 18 formed at its upstream end. A corresponding downstream end of the outlet portion 8 is formed with a concave semispherical surface 18' adapted to snuggly mate with the convex surface 1.

According to the second embodiment with the above-mentioned construction, even when the outlet portion 8 of the tundish 9 is caused to be deformed such that the axis of the outlet portion 8 is inclined with respect to the axis of the tundish nozzle 11, no gap is formed at the abutment 17 owing to the semispherical surfaces 18 and 18' so that leakage of molten metal can be positively prevented. So far it has been described that the upstream end of the intermediate member 19 has the convex semispherical surface 18 and the downstream end of the outlet portion 8 has the concave semispherical surface 18', but it is apparent that the intermediate member 19 may have concave semispherical upstream end while the downstream end of the outlet portion 8 may be in the form of convex semisphere. Alternatively, the complementary convex and concave semispherical surfaces may be provided on opposed ends of the intermediate member 19 and the tundish nozzle 11.

Figure 9:
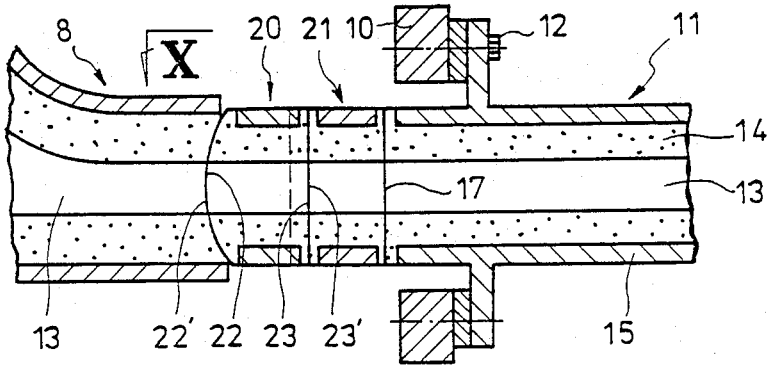
FIG. 9 is a sectional view of a third embodiment of the present invention.
Figure 10:
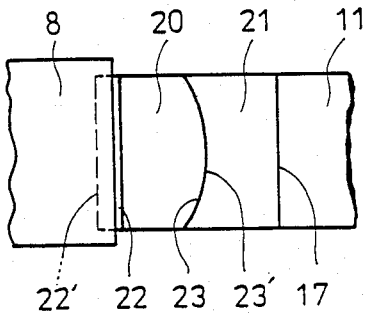
FIG. 10 is a view looking in the direction indicated by the arrow X in FIG. 9.

Referring next to FIGS. 9 and 10, a third embodiment of the present invention will be described in which first and second intermediate members 20 and 21 are interposed between the outlet portion 8 and the tundish nozzle 11. An upstream end of the intermediate member 20 has a convex semicylindrical surface 22; the downstream end of the outlet portion 8 has a concave semicylindrical surface 22' adapted to snugly mate with the convex surface 22. Furthermore, a downstream end of the intermediate member 20 has a convex semicylindrical surface 23 which is different in orientation by 90° from the semicylindrical surface 22 while the upstream end of the intermediate member 21 has a concave semicylindrical surface 23' adapted to snuggly mate with the convex surface 23.

With the third embodiment of the present invention with the above-mentioned construction, relative movements at the flat abutment 17 and the snugly mated convex and concave surfaces 22, 22', 23 and 23' will absorb deformation of the outlet portion 8 in every direction without leakage of molten metal. As is the case with the second embodiment described above, convexity and concavity of semicylindrical surfaces, formative positions thereof may be variously selected.

As described above, according to the present invention, the tundish nozzle is independent from the tundish and is supported by a stationary portion of the tundish car so that interference of the thermally deformed tundish nozzle with the continuous casting machine can be prevented and consequently a high degree of safety can be ensured. Furthermore the downstream end of the molten-metal pouring outlet portion of the tundish is securely pressed against the upstream end of the tundish nozzle by means of spring means or the like so that deformations of the tundish can be permitted and consequently the undesired force is prevented from being exerted to the tundish nozzle. In addition, one or more intermediate members each having semispherical or semicylindrical ends to absorb thermal deformations of the molten metal pouring outlet portion so that no gap is formed between the mating flat, semispherical and/or semicylindrical surfaces and consequently leakage of molten-metal can be positively prevented.

What is claimed is:

1. An apparatus for pouring molten metal in a moving-mold type continuous casting machine, comprising a tundish nozzle, a tundish car having a stationary portion, means for securing said tundish nozzle to said stationary portion by which said tundish nozzle is supported, and a tundish for supplying molten metal into said tundish nozzle mounted on said tundish car and having a molten-metal pouring outlet portion, said molten-metal pouring outlet being resiliently urged toward an end of said tundish nozzle.

2. The apparatus according to claim 1 wherein said molten-metal pouring outlet portion is pressed against said end of the tundish nozzle by spring means which interconnects said stationary portion of the tundish car and said tundish.

3. The apparatus according to claim 1 further comprising an intermediate member interposed between said tundish nozzle and said molten-metal pouring outlet portion for relative movement therebetween.

4. The apparatus according to claim 3 wherein an molten-metal pouring outlet portion is pressed against said end of the intermediate member by spring means which interconnects said stationary portion of the tundish car and said tundish.

5. The apparatus according to claim 3 wherein curved surfaces are defined between said molten-metal pouring outlet portion and said intermediate member for vertical relative rotation.

6. The apparatus according to claim 1 further comprising first and second intermediate members interposed between said tundish nozzle and said molten-metal pouring outlet portion for relative movement therebetween, curved surfaces being defined between said molten metal pouring outlet portion and the first intermediate member and between the first and second intermediate members for relative vertical and horizontal rotations.

* * * * *